United States Patent [19]

Yoo et al.

[11] 4,197,090

[45] Apr. 8, 1980

[54] PROCESS FOR REMOVING SULFUR FROM COAL

[75] Inventors: Jin S. Yoo, South Holland; Emmett H. Burk, Jr., Glenwood; John A. Karch, Chicago, all of Ill.

[73] Assignee: Atlantic Richfield Company, Philadelphia, Pa.

[21] Appl. No.: 876,784

[22] Filed: Feb. 10, 1978

[51] Int. Cl.[2] ..... C10L 9/10; C10B 57/00

[52] U.S. Cl. ..... 44/1 SR; 201/17

[58] Field of Search ..... 44/1 R; 201/17

[56] References Cited

U.S. PATENT DOCUMENTS

| | | | |
|---|---|---|---|
| 2,162,221 | 6/1939 | Kasehagen et al. | 44/1 R |
| 2,346,151 | 4/1944 | Burk et al. | 44/1 R |
| 3,824,084 | 7/1974 | Dillon et al. | 44/1 R |
| 3,909,211 | 9/1975 | Diaz et al. | 44/1 R |
| 3,960,513 | 6/1976 | Agarwal et al. | 44/1 R |
| 4,054,420 | 10/1977 | Loganbach | 44/1 R |

*Primary Examiner*—Carl F. Dees

*Attorney, Agent, or Firm*—John B. Goodman

[57] ABSTRACT

A process for reducing the pyritic sulfur content of coal comprising the steps of:

(1) contacting an aqueous slurry of water and pyrite-containing coal particles at elevated temperature with oxygen, the contacting of step 1 being such that without step 2 the aqueous slurry would have a pH of less than 5.5;

(2) maintaining the aqueous slurry of step 1 at a pH of from about 5.5 to 12.0; and (3) recovering coal particles of reduced pyritic sulfur content.

11 Claims, No Drawings

PROCESS FOR REMOVING SULFUR FROM COAL

BACKGROUND OF THE INVENTION

1. Field of the Invention

The field of this invention relates to a process for reducing the sulfur content of coal.

2. Prior Art

The problem of air pollution due to the emission of sulfur oxides when sulfur-containing fuels are burned has received increasing attention in recent years. It is now widely recognized that sulfur oxides can be particularly harmful pollutants since they can combine with moisture to form corrosive acidic compositions which can be harmful and/or toxic to living organisms in very low concentrations.

Coal is an important fuel, and large amounts are burned in thermal generating plants primarily for conversion into electrical energy. One of the principal drawbacks in the use of coal as a fuel is that many coals contain amounts of sulfur which generate unacceptable amounts of sulfur oxides on burning. For example, coal combustion is by far the largest single source of sulfur dioxide pollution in the United States at present, and currently accounts for 60 to 65% of the total sulfur oxide emissions.

The sulfur content of coal, nearly all of which is emitted as sulfur oxides during combustion, is present in essentially two forms: inorganic, primarily metal pyrites, and organic sulfur. The inorganic sulfur compounds are mainly iron pyrites, with lesser amounts of other metal pyrites and metal sulfates. The organic sulfur may be in the form of thiols, disulfide, sulfides and thiophenes (substituted, terminal and sandwiched forms) chemically associated with the coal itself. Depending on the particular coal, the sulfur content can be primarily in the form of either inorganic sulfur or organic sulfur. Distribution between the two forms varies widely among various coals.

In the United States, except for Western coals, the bulk of the coal produced is known to be high in pyrite. Both Appalachian and Eastern interior coals have been analyzed to be rich in pyritic and organic sulfur. Generally the pyritic sulfur represents from about 25% to 70% of the total sulfur content in these coals.

Heretofore, it was recognized that it would be highly desirable to remove (or at least lower) the sulfur content of coal prior to combustion. A number of processes, for example, have been suggested for removing the inorganic (pyritic) sulfur from coal.

For example, it is known that at least some pyritic sulfur can be physically removed from coal by grinding the coal, and subjecting the ground coal to froth flotation or washing processes. While such processes can remove some pyritic sulfur, these processes are not fully satisfactory because a large portion of the pyritic sulfur is not removed. Attempts to increase the portion of pyritic sulfur removed have not been successful because these processes are not sufficiently selective. Because the process is not sufficiently effective, a large portion of coal can be discarded along with ash and pyrite.

There have also been suggestions heretofore to chemically remove sulfur from coal. For example, U.S. Pat. No. 3,768,988 to Meyers, issued Oct. 30, 1973, discloses a process for reducing the pyritic sulfur content of coal involving exposing coal particles to a solution of ferric chloride. The patent suggests that in this process ferric chloride reacts with pyritic sulfur to provide free sulfur according to the following reaction process;

$$2FeCl_3+FeS_2 \rightarrow 3FeCl_2+S$$

While this process is of interest, a disadvantage of this process is that the liberated sulfur solids must then be separated from the coal solids. Processes involving froth flotation, and vaporization are proposed to separate the sulfur solids. All of these proposals, however, inherently represent a second discrete process step with its attendant problems and cost which must be employed to remove the sulfur from coal.

In another approach, U.S. Pat. No. 3,824,084 to Dillon issued July 16, 1974, discloses a process involving grinding coal containing pyritic sulfur in the presence of water to form a slurry, and then heating the slurry under pressure in the presence of oxygen. The patent discloses that under these conditions the pyritic sulfur (for example, $FeS_2$) can react to form ferrous sulfate and sulfuric acid which can further react to form ferric sulfate. The patent discloses that typical reaction equations for the process at the conditions specified are as follows:

$$FeS_2+H_2O+7/2O_2 \rightarrow FeSO_4+H_2SO_4$$

$$2FeSO_4+H_2SO_4+\tfrac{1}{2}O_2 \rightarrow Fe_2(SO_4)+H_2O$$

These reaction equations indicate that in this particular process the pyritic sulfur content continues to be associated with the iron as sulfate. While it apparently does not always occur, a disadvantage of this is that insoluble material, basic ferric sulfate, can be formed. When this occurs, a discrete separate separation procedure must be employed to remove this solid material from the coal solids to adequately reduce sulfur content. Several other factors detract from the desirability of this process. The oxidation of sulfur in the process does not proceed at a rapid rate, thereby limiting output for a given processing capacity. In addition, the oxidation process is not highly selective such that considerable amounts of coal itself can be oxidized. This is undesirable, of course, since the amount of coal recovered from the process is decreased.

Numerous other methods have been proposed for reducing the sulfur content of coal. For example, U.S. Pat. No. 3,938,966, to Kindig et al issued Feb. 17, 1976, discloses treating coal with iron carbonyl to enhance the magnetic susceptibility of iron pyrites to permit removal with magnets. In summary, while the problem of reducing the sulfur content of coal has received much attention, there still exists a present need for a practical method to more effectively reduce the sulfur content of coal.

SUMMARY OF THE INVENTION

This invention provides a practical method for more effectively reducing the sulfur content of coal. In its broad aspect, this invention presents a process for reducing the pyritic sulfur content of coal comprising the steps of:

(1) contacting an aqueous slurry of water and pyrite-containing coal particles at elevated temperature with oxygen, the contacting of step 1 being such that without step 2 the aqueous slurry would have a pH of less than 5.5;

(2) maintaining the aqueous slurry of step 1 at a pH of from about 5.5 to 12.0; and (3) recovering coal particles of reduced pyritic sulfur content.

A particularly important aspect of this invention is that the aqueous slurry is maintained at a pH in the range of from about 5.5 to 12.0 during the process. It has been discovered that maintaining the pH in this range provides faster reaction rates (reducing processing time), more selective oxidation of sulfur compounds, and some organic sulfur removal. These desirable attributes are important, and are made available in the process of this invention.

DETAILED DESCRIPTION OF THE INVENTION AND ITS PREFERRED EMBODIMENTS

This invention provides a method for reducing the pyritic sulfur content of coal by a process comprising the steps of:

(1) contacting an aqueous slurry of water and pyrite-containing coal particles at elevated temperature with oxygen, the contacting of step 1 being such that without step 2 the aqueous slurry would have a pH of less than 5.5;

(2) maintaining the aqueous slurry of step 1 at a pH of from about 5.5 to 12.0; and (3) recovering coal particles of reduced pyritic sulfur content.

The novel process of this invention is especially effective for reducing the pyritic sulfur content of coal. An advantage of the process is that it can also provide a reduction in the organic sulfur content of some coals.

Suitable coals which can be employed in the process of this invention include brown coal, lignite, subbituminous, bituminous (high volatile, medium volatile, and low volatile), semi-anthracite, and anthracite. Regardless of the rank of feed coal, excellent pyrite removal can be achieved by the process of this invention.

The coal particles employed in this invention can be provided by a variety of known processes, for example, grinding.

The particle size of the coal can vary over wide ranges and in general the particles need only be sufficiently small to enhance contacting with the aqueous medium. For instance, the coal may have an average particle size of one-fourth inch in diameter or larger in some instances, and as small as minus 200 mesh (Tyler Screen) or smaller. The most practical particle size is often minus 5 mesh, preferably minus 18 mesh, as less energy is required for grinding and yet the particles are sufficiently small to achieve an optimum rate of pyrite removal.

The manner of forming the aqueous slurry of water and coal particles is not critical. The aqueous slurry of water and coal can be formed, for example, by grinding coal in the presence of water or water can be added to coal particles of a suitable size. Preferably, the aqueous slurry contains from about 5 to about 50%, by weight, coal particles and more preferably from about 10 to about 30%, by weight, coal particles and the balance water.

From about 0.01 to 1%, by weight of coal, of a wetting agent can be a useful addition to the slurry. Suitable wetting agents include anionic, nonionic and amphoteric surfactants.

This aqueous slurry of coal is contacted, in a suitable vessel, for example, an autoclave, at elevated temperatures in the presence of oxygen, preferably at pressures above atmospheric, such that pyritic sulfur is preferentially oxidized without significant adverse oxidation of the coal substrate. For example, temperatures of from about 150° to 350° F., more preferably from about 175° to about 270° F. can be suitably employed. The oxygen can be present as pure oxygen gas or it can be mixed with other inert gases. For example, air or air enriched with oxygen can be suitably employed as a source of gaseous oxygen. Preferably, the gaseous oxygen is above atmospheric pressure, for example, pressures of from about 50 to 500 psig., and more preferably from about 100 to 400 psig. If the oxygen is mixed with other gases, the partial pressure of oxygen is most suitably within the pressure ranges mentioned hereinbefore.

Under these conditions, the oxygen gas and water readily remove pyritic sulfur from the coal. This removal involves oxidation of the pyritic sulfur to sulfate, thionate and thio sulfate forms. As the reaction proceeds, oxygen is consumed. Additional oxygen can be added to the system to maintain the partial pressure of oxygen.

The coal should be held under these conditions for a period of time sufficient to effect a significant reduction in the pyritic sulfur content, i.e., a reduction of 50%, and more preferably, a reduction of from 70% to 95% or more, by weight, of pyritic sulfur. Generally, a time period in the range of from about 5 minutes to 2 hours can be satisfactorily employed. Preferably, a time period of from 10 minutes to 1 hour is employed. During this time, it can be desirable to agitate the aqueous slurry of coal and water. Known mechanical mixers, for example, can be employed to agitate the slurry.

When coal containing pyritic sulfur is held under these reaction conditions, the pH of the aqueous slurry falls since sulfuric acid is formed in the reaction as pyrite is oxidized. This invention contemplates a process involving removing an amount of pyrite from coal such that without extrinsic addition of base material the pH would fall below 5.5. This is a condition which would generally occur if meaningful pyrite reduction is obtained. Without the addition of base, the final pH is greatly dependent on the level of pyritic sulfur in the feed coal. In such a situation, the final pH can be quite low, for example, the pH of the reaction slurry can fall to a pH of from about 1 to 3, or less. It has been found that if the pH of the aqueous slurry is maintained at from 5.5 to 12.0, preferably 6.5 to 10.0 that certain very distinct advantages are obtained. (As used herein, "maintain" means keeping the pH within the required limits for at least a period of time sufficient to substantially obtain the advantages of the invention). As noted hereinbefore, these advantages include faster reaction rates, and more selective oxidation. Just why these advantages are achieved is not fully understood. While not wishing to be bound to any particular theory, it is suggested that one reason for the advantage may be that the sulfur oxidized does not remain associated with the iron. The following chemical equation, employing, for example, ammonium bicarbonate to maintain pH, could be representative of the reaction course:

$$FeS_2 + O_2 + H_2O + NH_4HCO_3 \rightarrow Fe(OH)_3 \downarrow$$

or $$Fe_2(CO)_3 + (NH_4)_2SO_4$$

(wherein the $H_2SO_4$ is neutralized sufficiently to maintain the appropriate pH range required in the process of this invention).

It will be recognized by those skilled in the art that there are many ways to maintain the pH of the aqueous slurry within the desired range. For example, the pH of slurry can be continuously monitored using commercially available pH meters, and a suitable quantity of basic material can be metered to the slurry as needed to maintain the desired pH. Another suitable method for maintaining the pH in the desired range involves adding an appropriate amount of basic material to the aqueous slurry of coal and water prior to subjecting the slurry to the reaction conditions involving increased temperature and pressure.

Examples of suitable basic materials include alkali and alkaline earth metal hydroxides such as sodium hydroxide, potassium hydroxide, calcium hydroxide, magnesium hydroxide and their corresponding oxides. Other suitable basic materials include alkali and alkaline earth carbonates, such as sodium carbonate, sodium bicarbonate, potassium bicarbonate, ammonia, ammonium bicarbonate and ammonium carbonate. Among these basic materials, sodium hydroxide, sodium bicarbonate, potassium bicarbonate and ammonium bicarbonate are preferred. Suitable basic materials include suitable buffering agents, generally the salts of weak acids and strong bases.

Such buffering agents added to the aqueous slurry can be a very useful aid in maintaining the desired pH. An example of a suitable buffering agent is sodium acetate. As oxidation of the pyritic sulfur proceeds to generate sulfuric acid, part of the sodium acetate is converted to acetic acid to yield a buffer mixture, sodium acetate and acetic acid, in situ in the reactor.

Control of pH within a very narrow range can be achieved using such a buffering agent. The most suitable basic materials for maintaining the pH as required in this process are those having cations which form soluble salts with sulfur-oxygen anions such as thiosulfate, sulfate and thionate. The most suitable basic materials have anions comprising sodium, ammonium and/or potassium since such materials are readily available and form water soluble materials with sulfate.

After holding the aqueous slurry of coal particles and water under these reaction conditions for a sufficient time, the pyritic sulfur is substantially oxidized to water separable sulfur compounds, for example, water soluble sulfate salts.

This water, containing dissolved sulfur compounds, is separated from the coal particles. Such a liquids-solids separation is relatively simple, and can be effected in a variety of ways. Filtering with bar sieves or screens, or centrifuging, for example, can be employed to separate the coal and water.

The resulting coal product has a substantially reduced pyritic sulfur content and can exhibit a diminished organic sulfur content. Preferably, the coal is dried prior to use or storage.

The water separated from the coal, containing dissolved sulfate compounds, can be discarded or more preferably, is treated to remove the sulfate content. The sulfate content can be removed, for example, by treating the water with compounds which form insoluble compounds with sulfate. Preferably, the sulfate content is concentrated prior to such treatment, for example, by evaporating a portion of the water. For example, calcium hydroxide added to concentrated sulfate water solutions will form insoluble calcium sulfate which will precipitate from the water solution. The precipitate and water can be separated by conventional methods, such that the resulting water is substantially free of sulfate content.

The following specific embodiments are provided to more specifically illustrate the invention described herein.

EXAMPLE I

Portions of Illinois #6 coal were ground and screened to provide quantities of coal having a particle size of less than 100 mesh. Each of these portions (feed coal) was analyzed to determine its sulfur content and sulfur type. Each of the ground coal portions were then treated in the following manner. The portion of coal particles and water was added to an autoclave to form a slurry. In accordance with the invention, a quantity of alkali material (pH control agent) was added to the slurry to maintain a desired pH. The autoclave was sealed and heated to the indicated temperature, oxygen was then introduced to the autoclave and maintained at the indicated oxygen pressure. The coal was held under these conditions for a period of time, and then filtered to separate the coal and water.

The particular reaction conditions employed, and the reduction in sulfur content obtained are shown in Table I below.

TABLE I

| Run | pH Initial | pH Final | Reaction Conditions | Total Sulfur | Sulfur Type, (% Coal) Sulfate | Pyritic | Organic | % Sulfur Removal Pyritic | Organic | Total | Remarks |
|---|---|---|---|---|---|---|---|---|---|---|---|
| Feed Coal | — | — | — | 3.88 | 0.05 | 1.44 | 2.39 | — | — | — | No Treatment |
| 1 | 6.3 | 1.1 | 30 g. coal, 200 ml. water, 250° F. 400 psig.$O_2$, 1 Hr. | 2.86 | 0.02 | 0.41 | 2.25 | 76 | 6 | 27 | No pH Control |
| 2 | 8.2 | 5.5 | 30 g. coal, 200 ml. 0.2M $KHCO_3$, 250° F. 400 psig.$O_2$, 1 Hr. | 2.47 | 0.09 | 0.10 | 2.26 | 93 | 5 | 36 | pH control with $KHCO_3$ |

Run 1 is not an example of the invention, but is provided for comparative purposes to illustrate the advantage of the invention. Run 2 is an example of the invention. As can be seen, the reaction conditions of Run 2 provide greater pyritic sulfur removal than those employed in Run 1.

The process disclosed herein can be conducted on a batch, semi-continuous or continuous basis. All parts and percentages herein are based on weight unless otherwise specified.

What is claimed is:

1. A process for reducing the pyritic sulfur content of coal comprising:

(1) contacting an aqueous slurry of water and pyrite-containing coal particles at elevated temperature with oxygen;

(2) maintaining the aqueous slurry of step 1 at a pH of from about 5.5 to 12.0; and (3) separating water containing dissolved sulfur compounds from the coal particles.

2. The process of claim 1 wherein the pH in step 2 is from about 6.5 to 10.

3. The process of claim 1 wherein the temperature is from about 150° F. to about 350° F.

4. The process of claim 1 wherein the oxygen is at a pressure of from about 50 to 500 psig.

5. The process of claim 4 wherein oxygen gas is mixed with inert gas.

6. The process of claim 3 wherein the pH is maintained by adding an alkali material to the aqueous slurry.

7. The process of claim 6 wherein the alkali material is selected from the group consisting of potassium hydroxide, sodium hydroxide, potassium bicarbonate, sodium bicarbonate, ammonium bicarbonate and mixtures thereof.

8. The process of claim 3 wherein the aqueous slurry of water and coal particles contains from about 5 to 50%, by weight, coal particles.

9. The process of claim 8 wherein the aqueous slurry of water and coal particles contains from about 10 to 30%, by weight, coal particles.

10. The process of claim 3 wherein the coal particles have a particle size less than 5 mesh.

11. The process of claim 10 wherein the coal particles have a particle size less than 18 mesh.

* * * * *